US005307244A

United States Patent [19]

Gaudette

[11] Patent Number: 5,307,244

[45] Date of Patent: Apr. 26, 1994

[54] LIGHT-INSULATED LAMP AND ILLUMINATING SYSTEMS

[75] Inventor: Claude Gaudette, Costa Mesa, Calif.

[73] Assignee: Matthews Family Revocable Trust, Calif.

[21] Appl. No.: 3,764

[22] Filed: Jan. 13, 1993

Related U.S. Application Data

[63] Continuation-in-part of Ser. No. 724,221, Jul. 1, 1991, abandoned.

[51] Int. Cl.[5] ..... F21V 9/00

[52] U.S. Cl. ..... 362/29; 362/293; 362/351; 313/318

[58] Field of Search ..... 362/23, 26, 29, 30, 362/31, 263, 351, 800, 103, 105, 106, 108, 101; 313/318

[56] References Cited

U.S. PATENT DOCUMENTS 4,628,422 12/1986 Ewald ..... 362/800
4,774,643 9/1988 McGinnis et al. ..... 362/800
4,886,183 12/1989 Fleming ..... 362/101
5,095,412 3/1992 French ..... 362/800
5,119,279 6/1992 Makowsky ..... 362/800
5,149,734 9/1992 Fisher et al. ..... 524/423

FOREIGN PATENT DOCUMENTS 2497985 7/1982 France ..... 362/103

*Primary Examiner*—Richard R. Cole
*Attorney, Agent, or Firm*—Robbins, Berliner & Carson

[57] ABSTRACT

A light-insulated lamp, methods of preparing such lamp and illuminating systems using lamps therein are provided. The lamp is rendered light-insulated by providing leads with two portions, a first portion inside an envelope and a second portion extends out from a base at an angle of about 90° to the first portion, and encapsulating its base with an opaque plastic material, such as polybutylene terephthalate. The light-insulated lamp in combination with a compressive gasket and filter rings form an illuminating panel system which does not interfere with night vision goggles operation.

8 Claims, 2 Drawing Sheets

LIGHT-INSULATED LAMP AND ILLUMINATING SYSTEMS

This application in a continuation-in-part of Ser. No. 07/724,221 filed Jul. 1, 1991 now abandoned.

BACKGROUND OF THE INVENTION

1. Field of the Invention

The present invention relates to light insulated lamps, method of preparing such lamps and illuminating systems using such lamps therein. More specifically, the present invention is directed to encapsulating a base of a lamp with leads comprises two portions, a first portion inside an envelope and a second portion extends out from the base and at an angle of about 90° to the first portion, utilizing an opaque plastic material, such as polybutylene terephthalate (PBT). The lamp with the encapsulated base, in combination with a compressive gasket and filter ring is then used to obtain an illuminating system having IR sealing at the backside of an instrument panel which does not affect night vision goggle operation.

More specific objects and advantages of the invention will hereinafter be made clear or become apparent to those skilled in the art during the course of explanation of preferred embodiments of the invention.

2. Description of the Prior Art

In different applications, it is imperative that illumination, particularly from incandescent lamps, be rigorously controlled. One such application is the utilization of night vision goggles by operators of aircraft. In almost all instances, the instrument panels of aircraft are illuminated by incandescent light which is transmitted through a plastic panel such as molded acrylic plastic. The panel is painted or otherwise coated with opaque material which is then removed from desired spots for transmission of information to the pilot, such as, for example, data, instructional material, frequencies and the like. To provide light in the desired frequency ranges, a filtering element may be utilized so that incandescent radiation of undesired frequencies is eliminated from the acrylic plastic.

It has been found to be a problem that radiation of undesirable frequencies can leak from the incandescent lamp through the backboard with lamps made in accordance with the prior art. Typically, prior art lamps consist of an incandescent lamp with a pair of leads extending therefrom. The leads are then soldered to appropriate ± busses on top of the circuit board to provide the desired electrical connection to illuminate the lamp. Irrespective of the attempt to place opaque which materials or the like on the backboard, the light nonetheless leaks through, providing undesirable incandescent radiation at frequencies that sometimes degrade night vision goggles performance.

SUMMARY OF THE INVENTION

In accordance with the present invention, lamps for IR suppression illumination are provided which comprise an envelope including a base from which leads extend; the leads further comprises two portions, a first portion inside the envelope and a second portion which extends out from the base at its perimeter and at an angle of about 90° to the first portion, and opaque means, such as polybutylene terephthalate, for encapsulating the base so as to render the base light-insulated from IR illumination generated from the lamp.

In addition, IR suppression systems for illuminating instrument panels without interference with night goggles operation are provided which comprise the light insulated lamp described above, a backboard of an instrument panel on top of which the encapsulated base is attached; circuit connecting means on the backboard to which the leads are connected; a gasket having an outer sealing region and an inner opening that allows the envelope of the lamp to pass through tightly; enclosing means with filtering elements attached to a central opaque metallic cap embedded in transparent plastic means upon assembly; the enclosing means is further placed with its central metallic cap on top of the lamp with the filtering elements compressing the gasket over the encapsulated base, thereby sealing the lamp adjacent the filters to preclude light leakage between the encapsulated base and edge of the filters; and fastening means for attaching the transparent plastic means to the backboard for eliminating leakage of lights.

BRIEF DESCRIPTION OF THE DRAWINGS

The novel features which are believed to be characteristic of the invention are set forth with particularity in the appended claims. The invention itself, however, both as to its organization and method of operation, may best be understood by reference to the following description taken in connection with the accompanying drawings, wherein similar characters refer to similar elements throughout and in which:

DESCRIPTION OF THE PREFERRED EMBODIMENT

Figure 1:
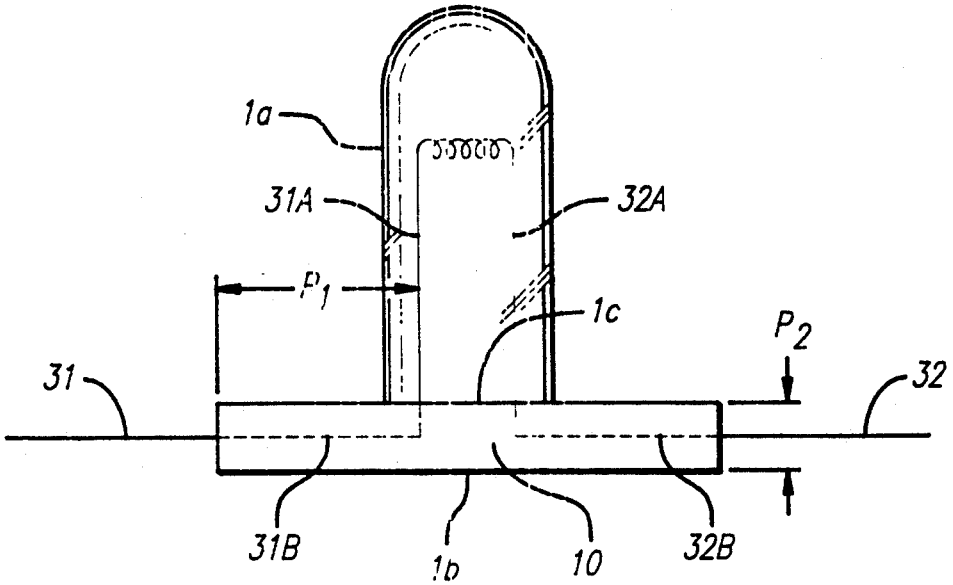
FIG. 1 is an elevational view of a lamp constructed in accordance with the present invention.
Figure 2:
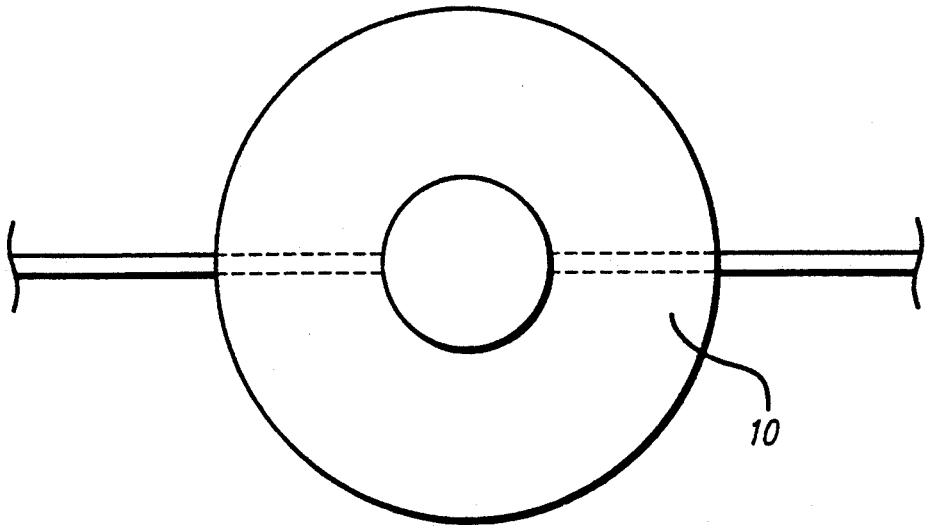
FIG. 2 is a top plan view thereof.
Figure 3:
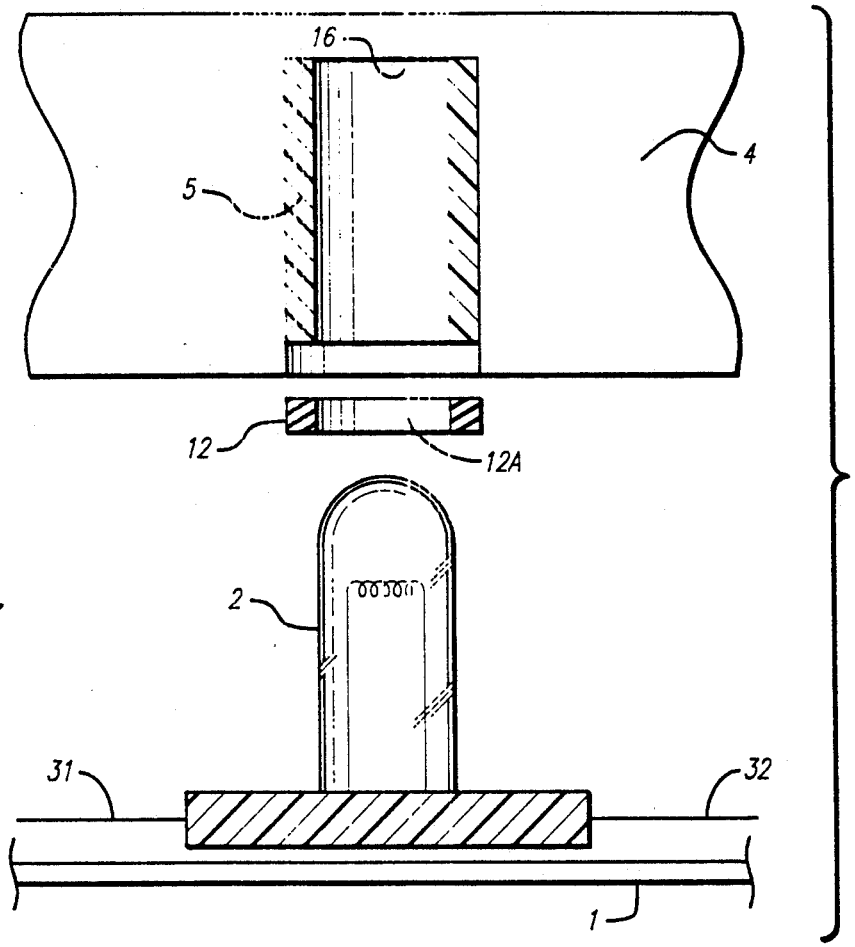
FIG. 3 is an exploded view showing the lamp mounted on a printed circuit board in end position for utilization within the instrument panel.

Referring now to FIGS. 1 and 2, the lamp includes an envelope 1*a* having a light-insulated base 1*b* constructed by encapsulating the original base 1*c* of the lamp as well as the two electrical leads 31 and 32 in a molded plastic 10 which is totally opaque, such as for example, PBT. For proper night vision goggle operation, it is critical that the second portions (31B and 32B) of the two leads 31 and 32, respectively, be at an angle of about 90° with the first portions (31A and 32A) once and remains embedded in the base until they extend out from the base at its perimeter. This specific lead arrangement allows a much longer light path $P_1$ for IR insulation providing performance much unexpected and superior over the conventional arrangement ($P_2$) with the second portions 31B and 32B of the leads 31 and 32, respectively, extend vertically down through the base at an angle of about 180°. Thus, a plastic encapsulated base is placed on top of the backboard as shown in FIG. 3 with the leads 31 and 32 then being soldered to the appropriate circuit connections. Thereafter, a compressible gasket 12 with a central opening 12*a* is placed over and around the lamp into contact with the plastic base as is shown generally in FIG. 3.

Figure 4:
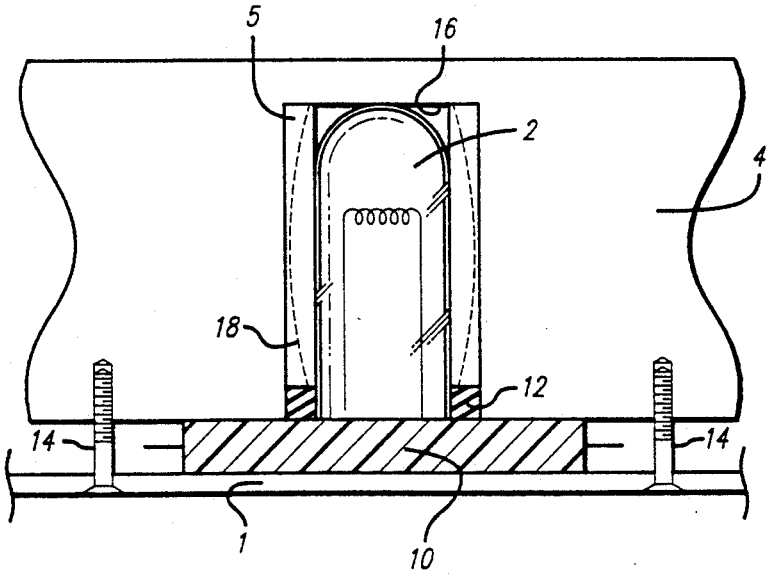
FIG. 4 is an assembled view of the part shown in FIG. 3.

Upon assembly, the filtering element 5 then contacts the gasket and compresses it as shown in FIG. 4 thereby sealing the lamp adjacent the filter 5 to preclude any light leakage between the plastic base and the edge of the filter 5. The backboard 1 is then tightly secured to the plastic plate 4 by fasteners such as screws 14 to tightly clamp the parts together and eliminate all leakage of the lights. The area 16 at the upper surface of the filter 5 is of an opaque metallic material such as aluminum, which also acts as a heat sink to dissipate heat generated during operation of the lamp. In such assembly, the radiation from the lamp is only through the filter 5 as shown by the dashed lines 18 on FIG. 4.

Those skilled in the art will fully appreciate that the present embodiment shown and desirable to illustrate the present invention is exemplary only and that the same principles may be employed in providing light insulated lamps. It will be further appreciated that various other minor modifications or changes, particularly with respect to details of component construction, might be made without departing from the gist and essence of the invention. Accordingly, it should be interpreted as encompassing all component constructions fairly regardable as functional equivalents of the subject matter to which claims are directed.

Having described our invention, what we claim and desire to secure by letter patent is:

1. A lamp for IR suppression illumination without interference with night goggles operation which comprises:

an envelope means including a base from which leads extend;

said leads further comprising two portions, a first portion inside said envelope and a second portion which remains embedded in the base until it extends out from the base at its perimeter and at an angle of about 90° to the first portion; and opaque means for encapsulating said base so as to render said base light-insulated from IR illumination generated from said lamp.

2. A lamp of claim 1 wherein further said opaque means is polybutylene terephthalate.

3. An IR suppression system for illuminating instrument panels without interference with night goggles operation which comprises:

a lamp having an envelope including a base from which leads extend;

said lamp further comprises opaque means for encapsulating said base so as to render said base light-insulated from IR illumination generated from said lamp;

a backboard of said instrument panel on top of which said encapsulated base is attached;

circuit connecting means on said backboard to which said leads are connected;

a gasket having an outer sealing section and an inner opening which allows said gasket having said envelope of said lamp to pass through;

enclosing means with filtering elements attached to a central opaque metallic cap embedded in transparent plastic means;

said plastic enclosing means further being placed with said central opaque metallic cap on top of said lamp, with said filtering elements compressing said gasket over said encapsulated base, thereby sealing said lamp adjacent said filtering elements to preclude light leakage between said encapsulated base and edge of said filtering elements; and fastening means for attaching said transparent plastic means to said backboard for eliminating leakage of light.

4. An IR suppression system of claim 3 wherein further said opaque means is polybutylene terephthalate.

5. A method for rendering a base of a lamp light insulated which comprises:

providing leads with two portions, a first portion inside an envelope and a second portion which remains embedded in the base until it extends out from the base at its perimeter at an angle of about 90° to the first portion; and encapsulating said base from which said second portion of said leads extend with an opaque means to prevent IR illumination generated by said lamp from illuminating through.

6. The method of claim 5 wherein further said opaque means is polybutylene terephthalate.

7. A method for providing an IR suppression system for illuminating instrument panels without interference with night goggles operation comprising the steps of:

(a) encapsulating a base of a lamp having an envelope including said base from which leads extend with opaque means so as to render said base light-insulated from IR illumination generated by said lamp;

(b) attaching said encapsulated base on top of a backboard of said instrument panel;

(c) connecting said leads of said lamp to circuit connecting means on said backboard;

(d) placing a gasket having an outer sealing section and an inner opening that allows said envelope of said lamp to pass through;

(e) placing enclosing means with filtering elements attached to a central opaque metallic cap embedded in transparent plastic means thereby compressing said central opaque metallic cap on top of said lamp and said outer sealing section of said gasket over said filtering elements to seal off light leaking between said encapsulated base and edge of said filtering elements; and (f) attaching said transparent plastic means to said backboard with fastening means for eliminating leakage of light.

8. The method of claim 7 wherein further said opaque means is polybutylene terephthalate.

* * * * *